US006963042B1

(12) United States Patent
Kouris

(10) Patent No.: US 6,963,042 B1
(45) Date of Patent: Nov. 8, 2005

(54) REMOTE CONTROLLED CIRCUIT BREAKER SWITCH HANDLE ENGAGEMENT APPARATUS

(76) Inventor: Harry Kouris, 628 Harrison Ave., SW., Rear Apt., Canton, OH (US) 44706-1316

( * ) Notice: Subject to any disclaimer, the term of this patent is extended or adjusted under 35 U.S.C. 154(b) by 120 days.

(21) Appl. No.: 10/714,125

(22) Filed: Nov. 17, 2003

(51) Int. Cl.[7] ..... H01H 5/00
(52) U.S. Cl. ..... 200/400; 200/331; 200/501; 335/14; 335/68
(58) Field of Search ..... 200/400, 401, 200/500, 501, 331; 335/14, 16–20, 68–76, 335/185–195

(56) References Cited

U.S. PATENT DOCUMENTS 3,581,032 A * 5/1971 Christensen ..... 200/50.15
4,057,794 A * 11/1977 Grossfield ..... 340/7.5
4,604,596 A 8/1986 Yokoyama et al.
4,879,535 A 11/1989 Mori et al.
RE33,325 E 9/1990 Yokoyama et al.
4,990,873 A * 2/1991 Grunert et al. ..... 335/68
5,172,291 A 12/1992 Bakely et al.
5,180,051 A 1/1993 Cook et al.
5,831,500 A 11/1998 Turner et al.
6,388,858 B1 5/2002 Simms et al.
6,469,600 B1 10/2002 Seese et al.
6,507,255 B1 1/2003 Ennis et al.
6,522,227 B1 * 2/2003 Mody et al. ..... 335/14

* cited by examiner

*Primary Examiner*—Richard K. Lee
(74) *Attorney, Agent, or Firm*—John D. Gugliotta; P. Jeff Martin

(57) ABSTRACT

A remote controlled circuit breaker switch handle engagement apparatus is provided. The apparatus is adapted to be removably attached across a circuit breaker face-plate of a traditional residential and commercial circuit breaker in order to facilitate remote completion of a circuit between a source and load, thereby reestablishing electrical service having been previously interrupted. The apparatus utilizes a handle trip assembly which engages an operating switch handle of the circuit breaker.

11 Claims, 5 Drawing Sheets

REMOTE CONTROLLED CIRCUIT BREAKER SWITCH HANDLE ENGAGEMENT APPARATUS

RELATED APPLICATIONS

The present invention was first described in Disclosure Document Registration No. filed on M, 2003 under 35 U.S.C. §122, 37 C.F.R. §1.14, and MPEP §1706. There are no previously filed, nor currently any co-pending applications, anywhere in the world.

BACKGROUND OF THE INVENTION

1. Field of the Invention

The present invention relates generally to remotely controllable circuit breakers and, more particularly, to a remote controlled circuit breaker switch handle engagement apparatus.

2. Description of the Related Art

There are various remote control circuit breakers in the art and commonly used in residential and light commercial applications for temporary interruption of electrical service which commonly occurs during peak usage hours or where load shedding is desired. However, such remote control circuit breakers are integral in nature, and thus are incapable of being utilized with existing circuit breakers.

Accordingly, there is a need for a portable, remote controlled circuit breaker switch handle engagement device which can be removably attached across the face plate of an existing or traditional circuit breaker in order to facilitate remote opening and closing of contacts in a manner which is quick, easy, and efficient. The development of the remote controlled circuit breaker switch handle engagement apparatus fulfills this need.

A search of the prior art did not disclose any patents that read directly on the claims of the instant invention; however, the following references were considered related.

The following patents disclose remotely controlled circuit switching systems:

- U.S. Pat. No. 4,879,535, issued in the name of Mori et al.;
- U.S. Pat. No. 4,604,596, issued in the name of Yokoyama et al.;
- U.S. Pat. No. 6,388,858 B1, issued in the name of Sims et al.;
- U.S. Pat. No. 5,180,051, issued in the name of Cook et al;
- U.S. Pat. No. 6,507,255 B1, issued in the name of Ennis et al.;
- U.S. Pat. No. 6,469,600 B1, issued in the name of Seese et al.; and
- U.S. Pat. No. Re. 33,325, issued in the name of Yokoyama et al.,
- U.S. Pat. No. 5,831,500, issued in the name of Turner et al. discloses a trip flag guide for a circuit breaker.
- U.S. Pat. No. 5,172,291, issued in the name of Blakely et al. discloses a relay arrangement for interrupting and switching the flow of alternating current, and means for controlling the relay arrangement.

Consequently, a need has been felt for a portable, remote controlled circuit breaker switch handle engagement device adapted for use with existing circuit breakers which facilitates remote completion of a circuit between a source and load in a manner which is quick, easy, and effective.

SUMMARY OF THE INVENTION

Therefore, it is an object of the present invention to provide an apparatus adapted to be removably attached to existing or traditional circuit breakers which reestablishes a current path between contacts therein.

It is another object of the present invention to provide a housing which protectively stores a handle trip assembly.

It is another object of the present invention to provide a handle trip assembly actuated remotely via a remote control transmitter.

It is another object of the present invention to provide a handle trip assembly adapted to urge a movable contact to engage a stationary contact in order to reestablish a current path therebetween, thereby reestablishing electrical service.

Briefly described according to one embodiment of the present invention, a remote controlled circuit breaker switch handle engagement apparatus is provided. The apparatus is adapted to be removably attached across a circuit breaker face-plate of a traditional residential and commercial circuit breaker in order to facilitate remote completion of a circuit between a source and load, thereby reestablishing electrical service having been previously interrupted. The apparatus comprises a housing configured for removable attachment across the circuit breaker face plate via a mounting means. The housing serves to protectively store a handle trip assembly.

The handle trip assembly comprises a worm gear which rotates about a pin mounted atop a bottom wall housing. The worm gear includes gear teeth for meshing with blades of a worm shaft. The worm gear further includes a coupling post mounted perpendicularly thereto, and which protrudes through a slotted aperture of plate member of a switch handle engagement arm. The switch handle engagement arm defines a downwardly depending prong which bifurcates into a pair of tines which form a switch handle engagement cavity. The switch handle engagement cavity is adapted to mate with the operating switch handle of a traditional residential circuit breaker, wherein the operating switch handle is received within cavity thereby facilitating moveable engagement of handle by the pair of convex tines 87.

The handle trip assembly further comprises a motor having a motor shaft adapted to rotate in opposing directions. A worm shaft coupler serves to couple the worm shaft to motor shaft. Thus as motor shaft rotates, the worm shaft rotates therewith.

Remote control of the handle trip assembly is provided via a remote control transmitter adapted to transmit signals to a receiver which transmits such signal to motor via connecting line. The remote control transmitter is equipped with a forward actuation button and a reverse actuation button wherein upon depression of a selected button, remote control transmitter is adapted to produce signals which are received by receiver which transmits such signals to motor, whereupon motor is adapted to then rotate motor shaft in a direction dictated by button selected. For example, upon depression of the forward actuation, forward or clockwise rotation of worm shaft via motor is actuated which causes worm gear to rotate counterclockwise, thus causing coupling post to move away from motor and engaging an end of slotted aperture and continues moving away from motor, thereby pulling plate member leftward. As a result, in view of operating switch handle being engaged by tines of switch handle engagement arm, operating switch handle is set in a leftward position, thus urging movable contact to engage stationary contact and reestablishing a current path therebetween.

The use of the present invention allows for the remote completion of a circuit between a source and load in a manner which is quick, easy, and effective.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

A. Detailed Description of the Figures

Figure 1:
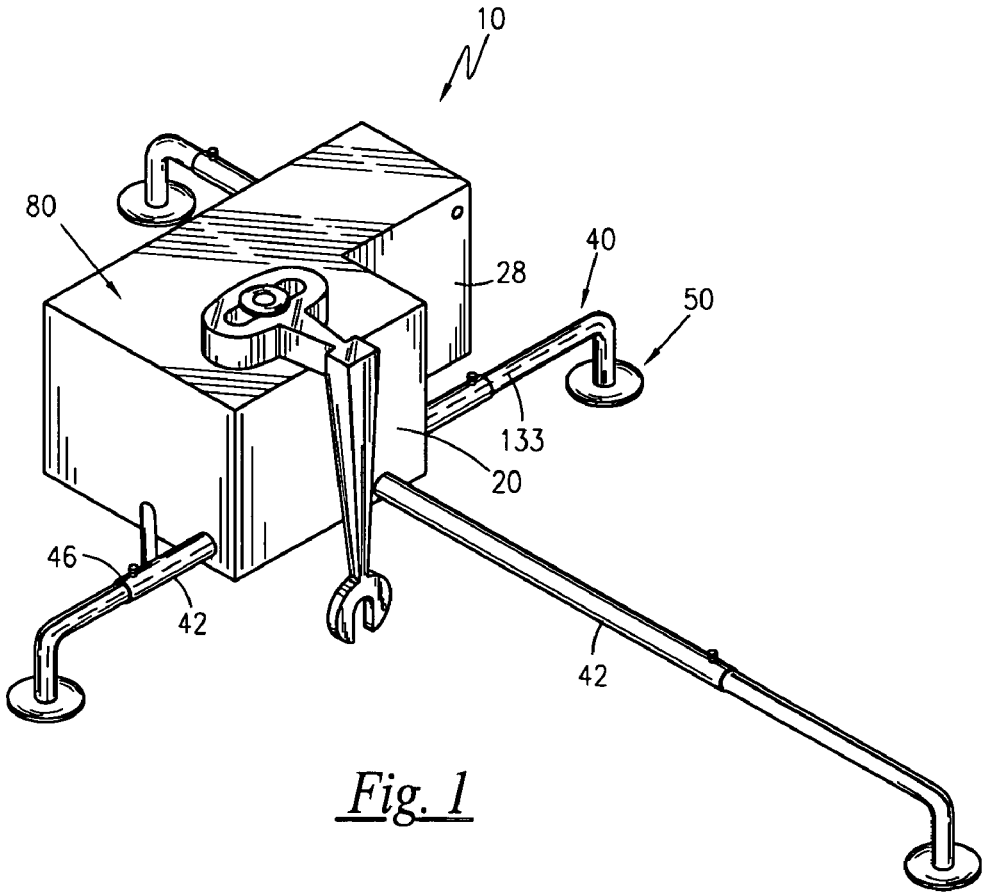
FIG. 1 is a perspective view of a remote controlled circuit breaker switch handle engagement apparatus, according to the preferred embodiment of the present invention.
Figure 2:
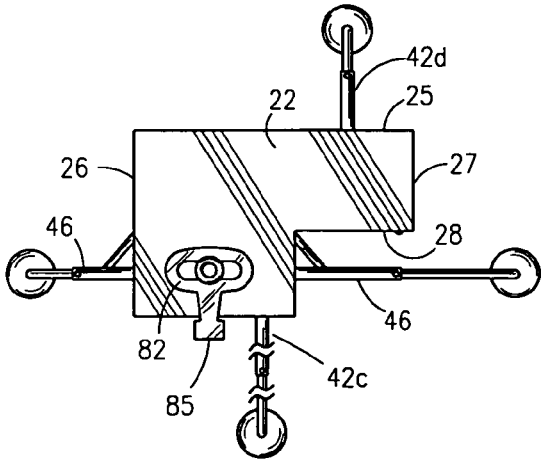
FIG. 2 is a top plan view thereof.
Figure 3:
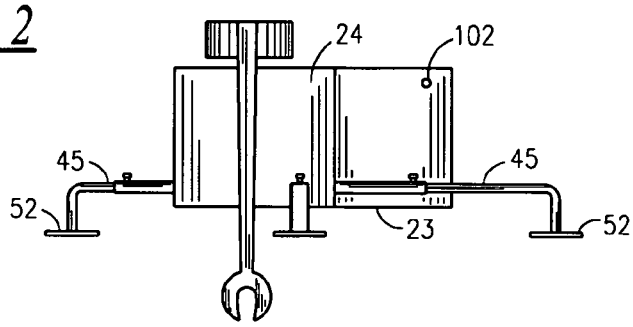
FIG. 3 is a front side elevational view thereof.
Figure 4:
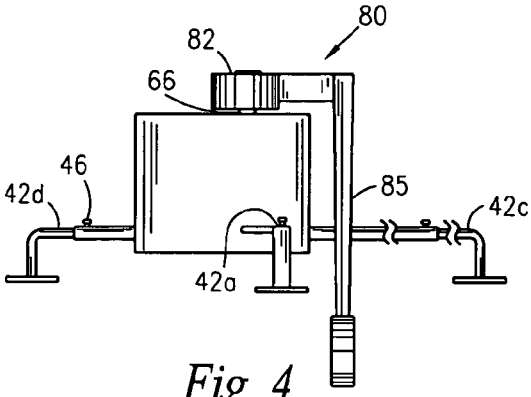
FIG. 4 is a left side elevational view thereof.
Figure 5:
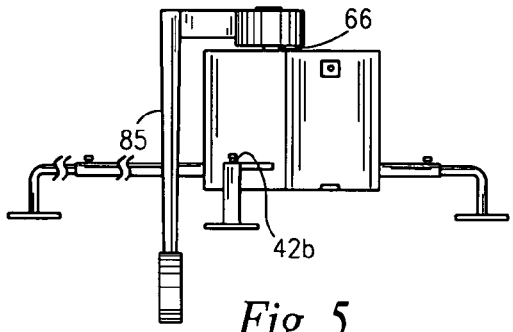
FIG. 5 is a right side elevational view thereof.
Figure 6:
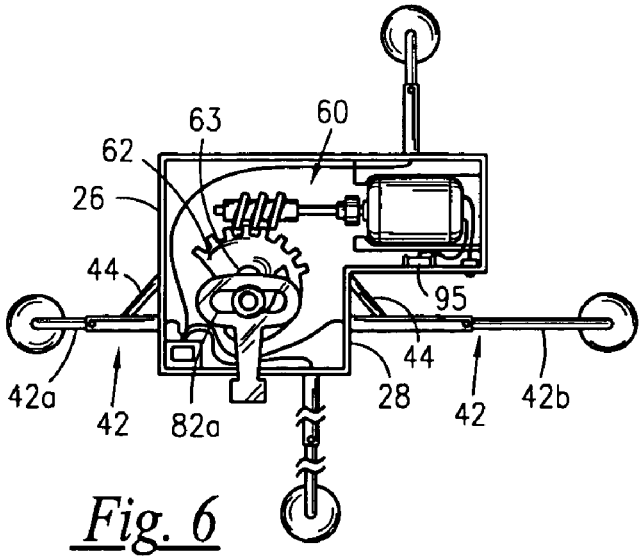
FIGS. 6–8 are top plan views of the remote controlled circuit breaker switch handle engagement apparatus, shown with the top wall removed to illustrate the handle trip assembly, according to the preferred embodiment of the present invention.
Figure 7:
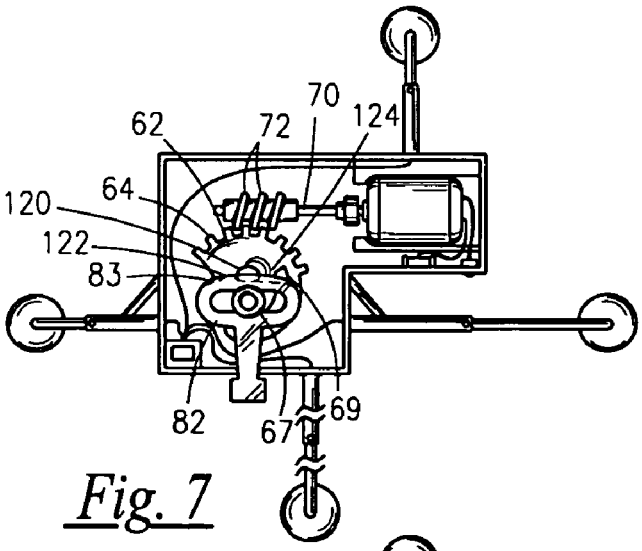
Figure 8:
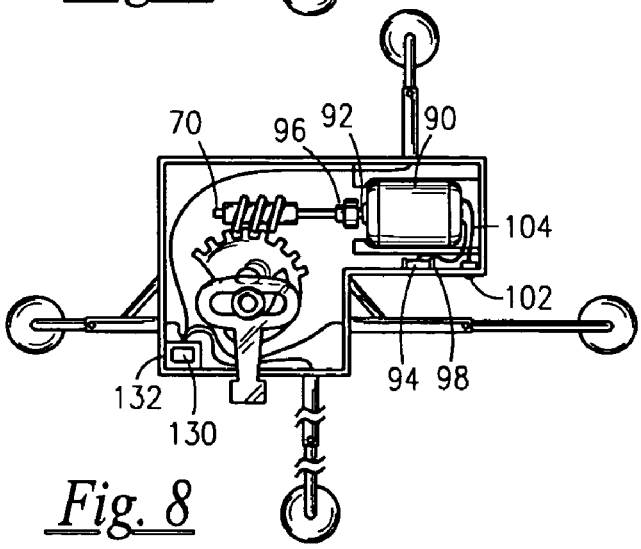
Figure 9:
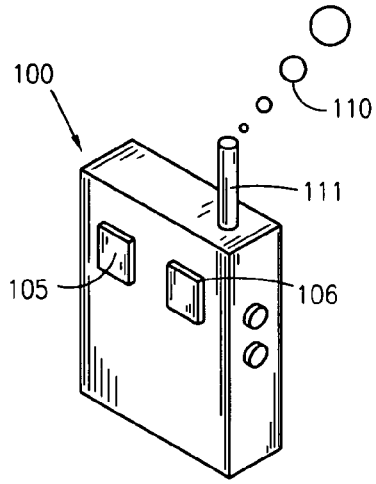
FIG. 9 is a perspective view of the remote control transmitter.

Referring now to FIGS. 1–9, and 12, a remote controlled circuit breaker switch handle engagement apparatus 10, hereinafter handle engagement apparatus 10, is shown, according to the present invention, comprised of a housing 20 adapted to be removably attached across a circuit breaker face-plate 32 of a traditional residential and commercial circuit breaker 30 in order to facilitate remote completion of a circuit between a source and load (not shown), thereby reestablishing electrical service having been previously interrupted. The housing 20 defines a top wall 22 opposing a bottom wall 23, a front wall 24 opposing a rear wall 25, and a left side wall 26 opposing a hinged door 27, wherein hinged door 27 has an L-shaped side wall 28 adjacent thereto and oriented at a right angle therewith which terminates integrally at the front wall 24. The hinged door 27 is adapted to be closed in a snap-tight frictional manner.

In order to facilitate removable attachment of housing 20 across the circuit breaker face plate 32, a mounting means 40 is provided. The mounting means 40 comprises a plurality of electrically-insulated telescopic brackets 42, wherein a first bracket 42*a* extends perpendicularly from the left side wall 26 and a second bracket 42*b* extends perpendicularly from the L-shaped side wall 28. A third bracket 42*c* extends perpendicularly from the front wall 24 and a fourth bracket 42*d* extends perpendicularly from the rear wall 25. The plurality of electrically-insulated telescopic brackets 42 are each linearly adjustable to a desired length, and locked via set screw 46. The first, second, third, and fourth bracket 42*a*, 42*b*, 42*c*, 42*d*, respectively, each has a right-angled foot 45 with an anchoring means 50 disposed perpendicularly thereon.

It is envisioned that the anchoring means 50 is a disc-shaped electromagnet 52 which provides strong magnetic attraction to the metal frame 34 which lies peripherally about the circuit breaker face-plate 32, thereby strongly securing housing 20 thereagainst. The disc-shaped electromagnet 52 is electrically connected by connecting line 133 to an electrical power source 130 residing within an electrical power source housing 132 mounted within housing 20 atop bottom wall 23 thereof adjacent worm gear 62.

Figure 10:
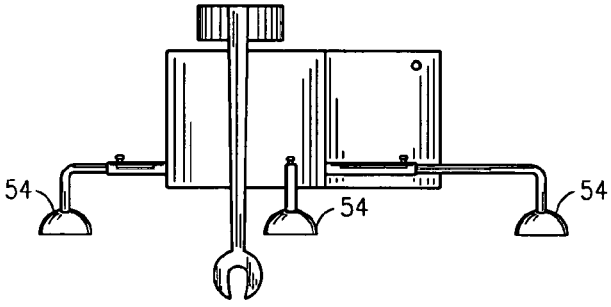
FIG. 10 is a side elevational view of the remote controlled circuit breaker switch handle engagement apparatus illustrating a first alternative anchoring means.
Figure 11:
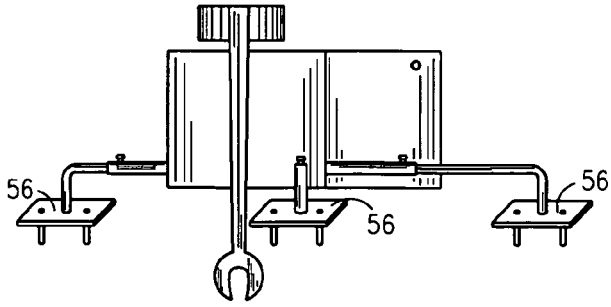
FIG. 11 is a side elevational view of the remote controlled circuit breaker switch handle engagement apparatus illustrating a second alternative anchoring means.
Figure 12:
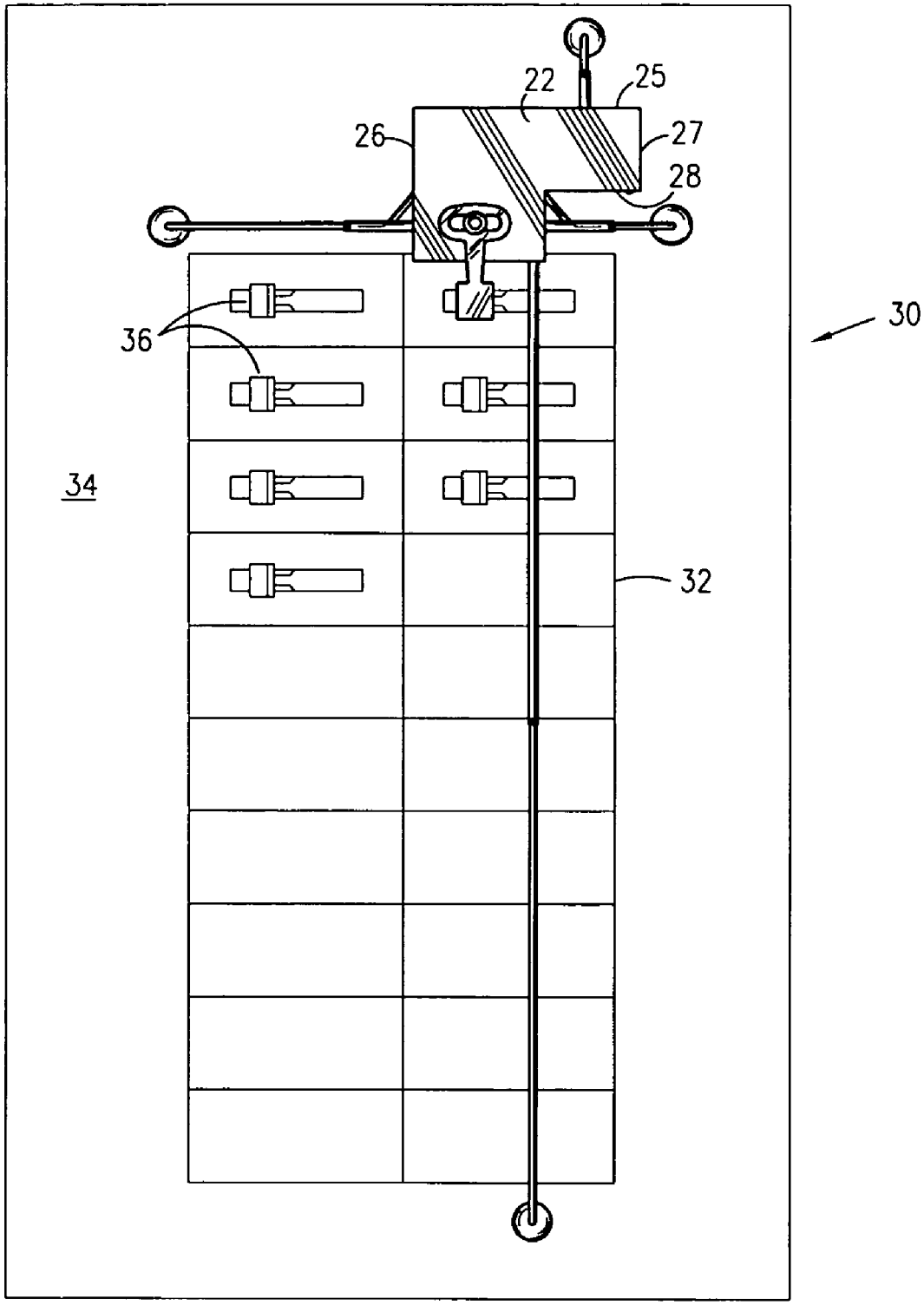
FIG. 12 is a perspective view of the remote controlled circuit breaker switch handle engagement apparatus shown in-use, according to the preferred embodiment of the present invention.

It is further envisioned that alternative anchoring means 50 are suitable for securing housing 20 against the circuit breaker face-plate 32 which includes suction cups 54 and anchoring plate with bolts 56, as shown in FIGS. 10 and 11, respectively.

In order to enhance structural rigidity to the housing 20 during operation, a cross support 44 extends integrally between the first bracket 42*a* and left side wall 26, and between the second bracket 42*b* and the L-shaped side wall 28 at a vertex thereof.

Stored within housing 20, a handle trip assembly 60 is provided for actuating movement of operating switch handle 36 right, thus in effect biasing movable contact (not shown) to OPEN POSITION, and movement left, thus biasing movable contact to CLOSED POSITION. The handle trip assembly 60 comprises a worm gear 62 which rotates about a pin 63 mounted atop bottom wall 23 of housing 20. The worm gear 62 includes gear teeth 64 for meshing with blades 72 of a worm shaft 70 (to be described in greater detail below). In order to maintain contact by gear teeth 64 with blades 72 of worm shaft 70, thereby preventing disengagement, a torsion spring 120 having a first arm 122 and a second arm 124 is disposed between the worm gear 62 and a plate member 82 (to be described in greater detail below). The first arm 122 is disposed in an aperture 83 in plate member 82 and the second arm 124 is disposed in a rectangular void 69 in worm gear 62. The torsion spring 120 is manufactured using a durable metal.

The worm gear 62 further includes a coupling post 66 mounted perpendicularly thereto, and which protrudes through a slotted aperture 82*a* of plate member 82 of a switch handle engagement arm 80. The coupling post 66 defines a circular cap 67 formed integral thereatop for mechanically engaging an upper surface of plate member 82 circumscribing the slotted aperture 82*a* thereof, thereby preventing removal of switch handle engagement arm 80.

The switch handle engagement arm 80 defines a downwardly depending prong 85 which bifurcates into a pair of convex tines 87 forming a switch handle engagement cavity 86. The switch handle engagement cavity 86 is adapted to mate with the operating switch handle 36 of a traditional residential circuit breaker 30, wherein the operating switch handle 36 is received within cavity 86 thereby facilitating moveable engagement of handle 36 by the pair of convex tines 87.

The handle trip assembly 60 further comprises a motor 90 having a motor shaft 92 adapted to rotate in opposing directions. The motor 90 snugly nests between motor support columns 93 formed integral within housing 20. Motor 90 receives driving power via a power source 94, shown herein as a rechargeable battery 95 which resides within a power source housing 98 mounted within housing 20 against L-shaped side wall 28, below motor 90.

A worm shaft coupler 96 serves to couple the worm shaft 70 to motor shaft 92. Thus as motor shaft 92 rotates, the worm shaft 70 rotates therewith via worm shaft coupler 96.

Remote control of the handle trip assembly 60 is provided via a remote control transmitter 100 adapted to transmit signals 110 to a receiver 102, mounted to L-shaped side wall, which transmits such signal to motor 90 via connecting line 104. The remote control transmitter 100 is equipped with a forward actuation button 105 and a reverse actuation button 106 wherein the forward actuation button 105, upon depression is adapted to produce signals 110 which are received by receiver 102 which transmits such signals 110 to motor 90, whereupon motor 90 is adapted to then rotate motor shaft 92 in a forward direction. The reverse actuation button 106, upon depression is adapted to produce signals 110 which are received by receiver 102 which transmits such signals 110 to motor 90, whereupon motor 90 is adapted to then rotate motor shaft 92 in a reverse direction. The remote control transmitter 100 includes an antenna 111 to facilitate signal transmission.

During operation, forward or clockwise rotation of worm shaft 70 via motor 90 causes worm gear 62 to rotate counterclockwise, thus causing coupling post 66 to move away from motor 90 and engaging an end of slotted aperture 82*a* and continues moving away from motor 90, thereby pulling plate member 82 leftward. As a result, in view of operating switch handle 36 being engaged by tines 87 of switch handle engagement arm 80, operating switch handle 36 is set in a leftward position, thus urging movable contact to engage stationary contact and reestablishing a current path therebetween.

In the event electrical service is interrupted leaving operating switch handle 36 in a position of equilibrium, the reverse actuation button 106 of the remote control transmitter 100 is depressed actuating reverse or counterclockwise rotation of worm shaft 70 via motor 90. As a result, worm gear 62 rotates clockwise causing coupling post 66 to move toward motor 90 and engages and end of slotted aperture 82*a* and continues moving toward motor 90, thereby pulling plate member 82 rightward. As a result, operating switch handle 36 is set in a rightward position. Operator then depresses the forward actuation button 105, necessarily setting operating switch handle 36 in a leftward position, and hence reestablishing a current path between movable contact and stationary contact, as previously described.

It is envisioned that a plurality of handle engagement apparatuses joined as a reticulated framework would be adapted to be removably attached across a circuit breaker face-plate 32 of a traditional residential and commercial circuit breaker 30 in order to facilitate remote-controlled completion of a circuit between a source and load. Each operating switch handle 36 of the circuit breaker face-plate would mate with a corresponding switch handle engagement cavity 86 of each switch handle engagement arm 80 of the reticulated framework, thereby urging all movable contacts to engage respective stationary contacts in a simultaneous and conjunctive manner in order to reestablish a current path therebetween.

2. Operation of the Preferred Embodiment

To use the present invention, user attaches the handle engagement apparatus 10 across the circuit breaker face-plate 32 and mates a selected operating switch handle 36 with the switch handle engagement cavity 86 of tines 87. From a remote location, user selects and depresses the forward actuation button 105 or the reverse actuation button 106, dependent upon user need, whereupon signals 110 are produced and received by receiver 102. The receiver 102 transmits such signals 110 to motor 90, whereupon motor 90 is adapted to then rotate motor shaft 92 in a direction correspondent to button 105, 105 depressed. As a result, movable contact is urged to engage stationary contact, thereby reestablishing a current path therebetween.

The use of the present invention allows for the remote completion of a circuit between a source and load in a manner which is quick, easy, and effective.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents. Therefore, the scope of the invention is to be broadly limited only by the following claims.

What is claimed is:

1. A circuit breaker switch handle engagement apparatus comprising:

a housing, said housing defines a top wall opposing a bottom wall, a front wall opposing a rear wall, and a left side wall opposing a hinged door, wherein said hinged door has an L-shaped side wall adjacent thereto and oriented at a right angle with said hinged door, wherein said L-shaped side wall terminates integrally at the front wall, said housing is adapted to be removably attached across a circuit breaker face-plate of a traditional residential and commercial circuit breaker;

a mounting means, said mounting means facilitates removable attachment of said housing across the circuit breaker face-plate, wherein said mounting means comprises a plurality of electrically-insulated telescopic brackets and a cross support, wherein said plurality of electrically-insulated telescopic brackets includes a first bracket which extends perpendicularly from said left side wall, a second bracket which extends perpendicularly from said L-shaped side wall, a third bracket which extends perpendicularly from said front wall and a fourth bracket which extends perpendicularly from said rear wall, wherein each of said plurality of electrically-insulated telescopic brackets are linearly adjustable to a desired length and locked via set screw;

a handle trip assembly, said handle trip assembly is stored within said housing, wherein said handle trip assembly actuates movement of an operating switch handle of the traditional residential and commercial circuit breaker; and a remote control transmitter, said remote control transmitter is adapted to activate control of said handle trip assembly in a remote manner.

2. The circuit breaker switch handle engagement apparatus of claim 1, wherein said cross support extends integrally between said first bracket and said left side wall, and said cross support extends between said second bracket and said L-shaped side wall at a vertex of said L-shaped side wall, thereby enhancing structural rigidity to said housing during operation.

3. The circuit breaker switch handle engagement apparatus of claim 1, wherein each of said first bracket, said second bracket, said third bracket, and said fourth bracket has a right-angled foot with an anchoring means disposed perpendicularly thereon, said anchoring means is a disc-shaped electromagnet which provides strong magnetic attraction to a metal frame lying peripherally about the circuit breaker face-plate, thereby strongly securing said housing against the metal frame of the circuit breaker-face plate, said disc-shaped electromagnet is electrically connected by connecting line to an electrical power source residing within an electrical power source housing, said electrical power source housing is mounted within said housing atop said bottom wall and adjacent said worm gear.

4. The circuit breaker switch handle engagement apparatus of claim 3, wherein said anchoring means is a suction cup.

5. The circuit breaker switch handle engagement apparatus of claim 3, wherein said anchoring means is an anchoring plate with bolts.

6. The circuit breaker switch handle engagement apparatus of claim 1, wherein said hinged door is adapted to be closed in a snap-tight frictional manner.

7. A circuit breaker switch handle engagement apparatus comprising:

a housing, said housing defines a top wall opposing a bottom wall, a front wall opposing a rear wall, and a left side wall opposing a hinged door, wherein said hinged door has an L-shaped side wall adjacent thereto and oriented at a right angle with said hinged door, wherein said L-shaped side wall terminates integrally at the front wall, said housing is adapted to be removably attached across a circuit breaker face-plate of a traditional residential and commercial circuit breaker;

a mounting means, said mounting means facilitates removable attachment of said housing across the circuit breaker face-plate;

a handle trip assembly, said handle trip assembly is stored within said housing, wherein said handle trip assembly actuates movement of an operating switch handle of the traditional residential and commercial circuit breaker, wherein said handle trip assembly comprises a worm gear, said worm gear rotates about a pin mounted atop said bottom wall of said housing, said worm gear includes gear teeth for meshing with blades of a worm shaft, wherein said worm gear and a plate member have a torsion spring disposed therebetween in order to maintain contact by said gear teeth with said blades of said worm shaft, thereby preventing disengagement, said torsion spring has a first arm disposed in an aperture in said plate member and a second arm disposed in a rectangular void in said worm gear, wherein said worm gear includes a coupling post mounted perpendicularly to said worm gear, said coupling post protrudes through a slotted aperture of said plate member of a switch handle engagement arm, and wherein said coupling post defines a circular cap formed integral thereatop for mechanically engaging an upper surface of said plate member, said circular cap circumscribes said slotted aperture of said plate member, thereby preventing removal of said switch handle engagement arm, wherein said switch handle engagement arm defines a downwardly depending prong which bifurcates into a pair of convex tines forming a switch handle engagement cavity, wherein said switch handle engagement cavity is adapted to mate with the operating switch handle of the traditional residential circuit breaker, wherein the operating switch handle is received within said switch handle engagement cavity, thereby facilitating moveable engagement of the operating switch handle by said pair of convex tines; and a remote control transmitter, said remote control transmitter is adapted to activate or deactivate control of said handle trip assembly in a remote manner.

8. The circuit breaker switch handle engagement apparatus of claim 7, wherein said handle trip assembly further comprises a motor having a motor shaft adapted to rotate in opposing directions, said motor snugly nests between motor support columns formed integral within said housing, said motor receives driving power via a power source which resides within a power source housing mounted within said housing against said L-shaped side wall, below said motor, said worm shaft is coupled to said motor shaft via a worm shaft coupler, thus as said motor shaft rotates, said worm shaft rotates therewith via said worm shaft coupler.

9. The circuit breaker switch handle engagement apparatus of claim 7, wherein said hinged door is adapted to be closed in a snap-tight frictional manner.

10. A circuit breaker switch handle engagement apparatus comprising:

a housing, said housing defines a top wall opposing a bottom wall, a front wall opposing a rear wall, and a left side wall opposing a hinged door, wherein said hinged door has an L-shaped side wall adjacent thereto and oriented at a right angle with said hinged door, wherein said L-shaped side wall terminates integrally at the front wall, said housing is adapted to be removably attached across a circuit breaker face-plate of a traditional residential and commercial circuit breaker;

a mounting means, said mounting means facilitates removable attachment of said housing across the circuit breaker face-plate;

a handle trip assembly, said handle trip assembly is stored within said housing, wherein said handle trip assembly actuates movement of an operating switch handle of the traditional residential and commercial circuit breaker; and a remote control transmitter, said remote control transmitter is adapted to activate control of said handle trip assembly in a remote manner;

wherein said remote control transmitter is adapted to transmit signals to a receiver being mounted to said L-shaped side wall of said housing, wherein said receiver transmits said signals to said motor via connecting line, said remote control transmitter is equipped with a forward actuation button and a reverse actuation button, wherein said forward actuation button, upon depression, is adapted to produce signals which are received by said receiver which then transmits said signals to said motor, whereupon said motor is adapted to then rotate said motor shaft in a forward direction, said reverse actuation button, upon depression, is adapted to produce signals which are received by said receiver which then transmits said signals to said motor, whereupon said motor is adapted to then rotate said motor shaft in a reverse direction, and wherein said remote control transmitter includes an antenna to facilitate signal transmission, wherein forward or clockwise rotation of said worm shaft via said motor causes said worm gear to rotate counterclockwise, thus causing said coupling post to move away from said motor and engage an end of said slotted aperture of said plate member, and wherein said coupling post continues moving away from said motor, thereby pulling said plate member leftward, resulting in the operating switch handle being set in a leftward position, and thus urging movable contact to engage stationary contact and reestablishing a current path therebetween, and wherein counterclockwise rotation of said worm shaft via said motor results in clockwise rotation by said worm gear causing said coupling post to move toward said motor and engage and end of said slotted aperture, and wherein said coupling post continues moving toward said motor, thereby pulling said plate member rightward, resulting in the operating switch handle being set in a rightward position.

11. The circuit breaker switch handle engagement apparatus of claim 10, wherein said hinged door is adapted to be closed in a snap-tight frictional manner.

* * * * *